US009457288B2

(12) United States Patent
Choi

(10) Patent No.: US 9,457,288 B2
(45) Date of Patent: Oct. 4, 2016

(54) MAGNETIC BLOCK TOY

(71) Applicant: Click-Block Corporation, Rolling Meadows, IL (US)

(72) Inventor: So Young Choi, Gyeonggi-do (KR)

(73) Assignee: Click-Block Corporation, Rolling Meadows, IL (US)

( * ) Notice: Subject to any disclaimer, the term of this patent is extended or adjusted under 35 U.S.C. 154(b) by 0 days.

(21) Appl. No.: 14/718,882

(22) Filed: May 21, 2015

(65) Prior Publication Data

US 2016/0206968 A1 Jul. 21, 2016

(30) Foreign Application Priority Data

Jan. 20, 2015 (KR) ..... 10-2015-0009312

(51) Int. Cl.
*A63H 33/04* (2006.01)
*A63H 33/08* (2006.01)

(52) U.S. Cl.
CPC ..... *A63H 33/046* (2013.01); *A63H 33/084* (2013.01)

(58) Field of Classification Search
CPC ..... A63H 33/046
See application file for complete search history.

(56) References Cited

U.S. PATENT DOCUMENTS

| | | | | |
|---|---|---|---|---|
| 2,846,809 | A * | 8/1958 | Majewski | A63H 33/103 434/278 |
| 3,601,921 | A * | 8/1971 | Strohmaier | A63H 33/046 446/92 |
| 6,626,727 | B2 * | 9/2003 | Balanchi | A63H 33/108 273/157 R |
| 6,846,216 | B1 * | 1/2005 | Balanchi | A63H 33/046 273/157 R |
| 7,988,518 | B2 * | 8/2011 | Kim | A63H 33/046 446/129 |
| 8,070,550 | B2 * | 12/2011 | Song | A63H 33/046 446/129 |
| 2014/0094083 | A1 * | 4/2014 | Vandoren | A63H 33/046 446/92 |

* cited by examiner

*Primary Examiner* — John Ricci
(74) *Attorney, Agent, or Firm* — Levenfeld Pearlstein, LLC

(57) ABSTRACT

The present invention relates to a magnetic block toy, and more particularly, to a magnetic block toy which makes assembly of blocks firm because caps having serrated coupling parts are combined to both sides of a block body, and which has block bodies and caps of various colors, thereby arousing children's interest and promoting development of intelligence.

The magnetic block toy according to the present invention includes: a block body having a pair of brackets each of which has a protrusion and a groove formed on the inner face to correspond to each other and are coupled with each other; caps which are respectively combined to both sides of the block body and each of which has a serrated coupling part formed on the outer surface; and a magnet which is disposed inside the cap to generate a magnetic force.

6 Claims, 9 Drawing Sheets magnetic force measurement without a metal fixing board circular magnet 7ϕ/4T measuring tool: KANETEC, Tesla Meter TM-701

Gauss: 336.0 magnetic force measurement with a metal fixing board circular magnet 7ϕ/4T + metal fixing board 8ϕ/1T measuring tool: KANETEC, Tesla meter TM-701

Gauss: 371.0

MAGNETIC BLOCK TOY

TECHNICAL FIELD

The present invention relates to a magnetic block toy, and more particularly, to a magnetic block toy which makes assembly of blocks firm because caps having serrated coupling parts are combined to both sides of a block body, and which has block bodies and caps of various colors, thereby arousing children's interest and promoting development of intelligence.

BACKGROUND ART

In general, block toys are to build structures of various forms when a user assembles a plurality of three-dimensional assembly blocks with each other, so that the block toys provide children with various educational effects and are widely used as playthings which allow the user to creatively make various models.

Moreover, block toys make the user feel pleasure obtained through an assembling process and a sense of accomplishment through the process to make a special structure by assembling the blocks, which are unit structures of a simple form, as the user intended, increase the user's intellectual capacity through a training to design and make a three-dimensional structure, and have good influences, such as enhancement of cognitive skills and body development, on infants or children.

Such block toys have various three-dimensional shapes of the simplest form, such as polyprisms, cylinders, polypyramids, cones and many-sided panels, made of wood or synthetic resin, and the user can use the block toy by building up the blocks.

In the meantime, differently from the built-up type block toy, block toys using magnets as combining means for blocks have been developed and gain a lot of popularity recently. Such magnetic block toys having the magnets each of which is arranged at the end portion thereof and has the N pole and the S pole are assembled into structures of various forms by combining fixed blocks by a medium of magnetic metal materials.

The following cited reference 1 discloses an example of such technology.

The cited reference 1 discloses a magnetic block toy including: a metallic magnet part having magnets arranged at both end portions; a pair of synthetic resin bodies having a receiving space to which the metallic magnet part can be accommodated and bonded in such a way that a part of the magnet is exposed to the outside when the synthetic resin bodies are coupled oppositely; a magnetic block toy stick having claw coupling parts which are disposed at end portions opposed to each other of the synthetic resin bodies to claw hold of the synthetic resin bodies; and a plurality of metal members magnetically bonded to both end portions of the magnetic block toy stick.

The conventional block toy has an assembly structure to be manufactured through a simple manufacturing process, is simple and easy in assembly, thereby being manufactured in a way that is easier and more convenient than the conventional methods and preventing the magnet from being separated to the outside.

However, such a conventional technology has a disadvantage in that the assembled structure may be easily collapsed or distorted and it is difficult to maintain the assembled structure for a long time because the blocks are built up or assembled into three-dimensional structures because the blocks depend on nothing but the combining force of the magnets.

PRIOR ART DOCUMENTS

Patent Documents

Patent Document 1: Korean Utility Model Registration No. 20-0464973 (registered on Jan. 21, 2013)

DISCLOSURE

Technical Problem

Accordingly, the present invention has been made in an effort to solve the above-mentioned problems occurring in the prior arts, and it is an object of the present invention to provide a magnetic block toy which makes assembly of blocks firm because caps having serrated coupling parts are combined to both sides of a block body so that an assembled structure can stand for a long time without being easily collapsed.

It is another object of the present invention to provide a magnetic block toy which has block bodies and caps of various colors, lengths and forms, thereby arousing children's interest and promoting development of intelligence.

Technical Solution

To achieve the above objects, the present invention provides a magnetic block toy including: a block body having a pair of brackets each of which has a protrusion and a groove formed on the inner face to correspond to each other and are coupled with each other; caps which are respectively combined to both sides of the block body and each of which has a serrated coupling part formed on the outer surface; and a magnet which is disposed inside the cap to generate a magnetic force.

Advantageous Effects

As described above, according to the present invention, the magnetic block toy makes assembly of the blocks firm because the caps having the serrated coupling parts are combined to both sides of the block body so that an assembled structure can stand for a long time without being easily collapsed.

Additionally, the magnetic block toy has the block bodies and caps of various colors so as to arouse children's interest and enhance an aesthetic sense, and has the block bodies of various lengths and forms to allow the children to assemble the block toys into various three-dimensional structures, thereby promoting development of intelligence.

MODE FOR INVENTION

A magnetic block toy according to the present invention includes: a block body having a pair of brackets each of which has a protrusion and a groove formed on the inner face to correspond to each other and are coupled with each other; caps which are respectively combined to both sides of the block body and each of which has a serrated coupling part formed on the outer surface; and a magnet which is disposed inside the cap to generate a magnetic force.

Moreover, the block body is formed in one selected from a straight line form and a curved line form.

Furthermore, a plurality of split support pieces outwardly protrude from both sides of the block body, a retaining piece is formed integrally with an end portion of the support piece, and a retaining groove is formed on the outer circumferential surface of the cap so that the retaining piece is caught to the retaining groove.

Additionally, a magnet fixing board for fixing the magnet is disposed inside the cap, and supporters protrude from the center of both sides of the block body to be coupled with the caps and support the magnet fixing board.

In addition, a magnet exposing hole is formed at the center of the cap to partially expose the magnet to the outside when the caps are coupled with each other.

Hereinafter, reference will be now made in detail to the preferred embodiment of the present invention with reference to the attached drawings.

Figure 1:
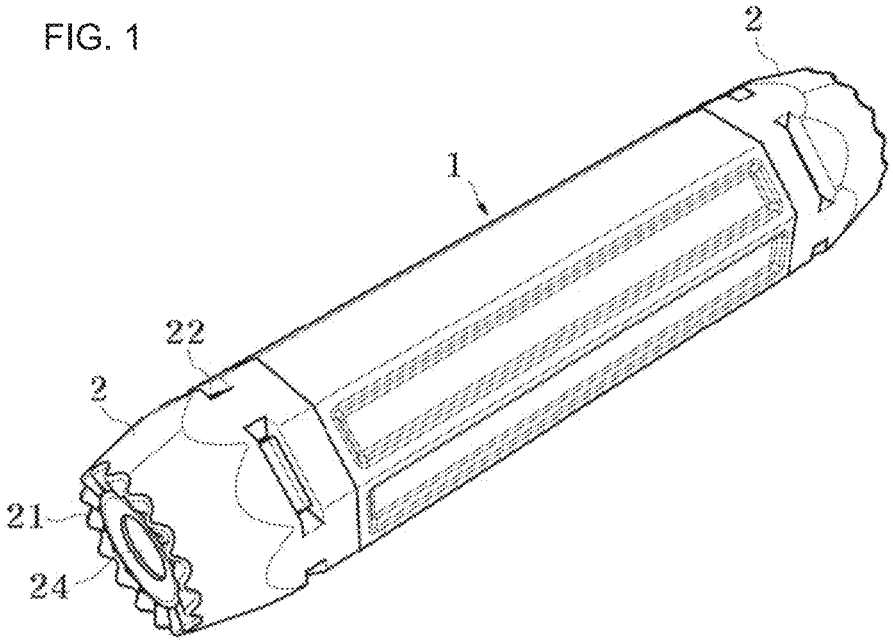
FIG. 1 is a perspective view of a magnetic block toy according to the present invention.
Figure 2:
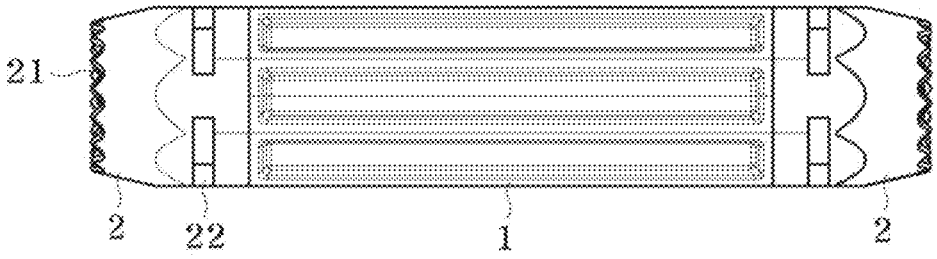
FIG. 2 is a front view of the magnetic block toy according to the present invention.
Figure 3:
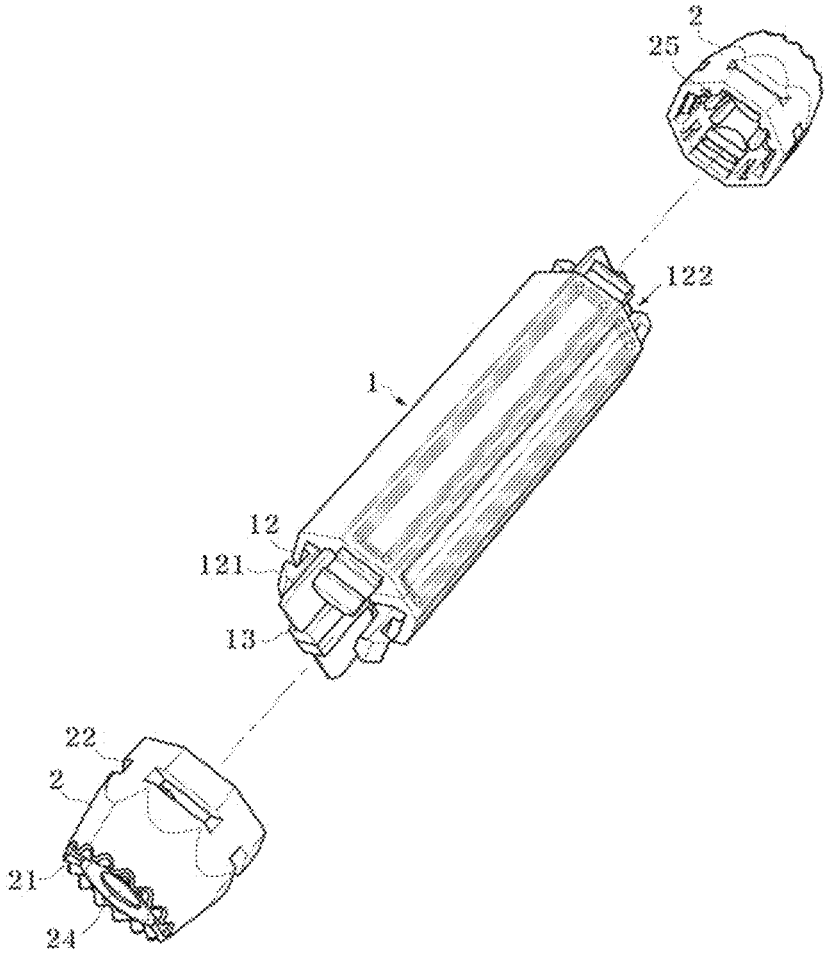
FIG. 3 is an exploded perspective view of the magnetic block toy according to the present invention.
Figure 4:
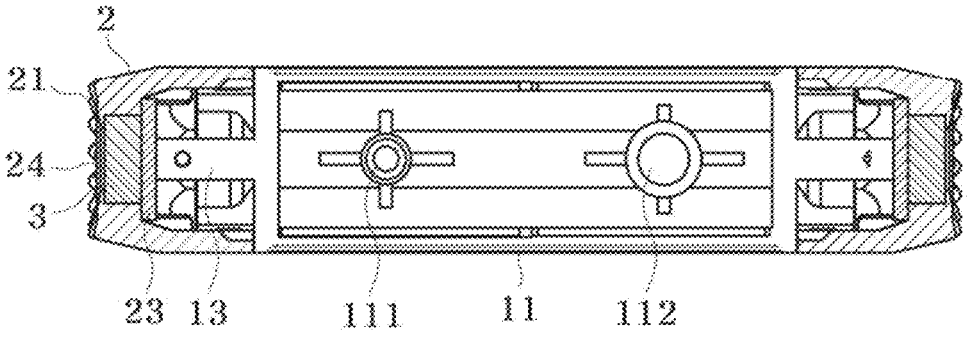
FIG. 4 is a sectional view of the magnetic block toy according to the present invention.
Figure 5:
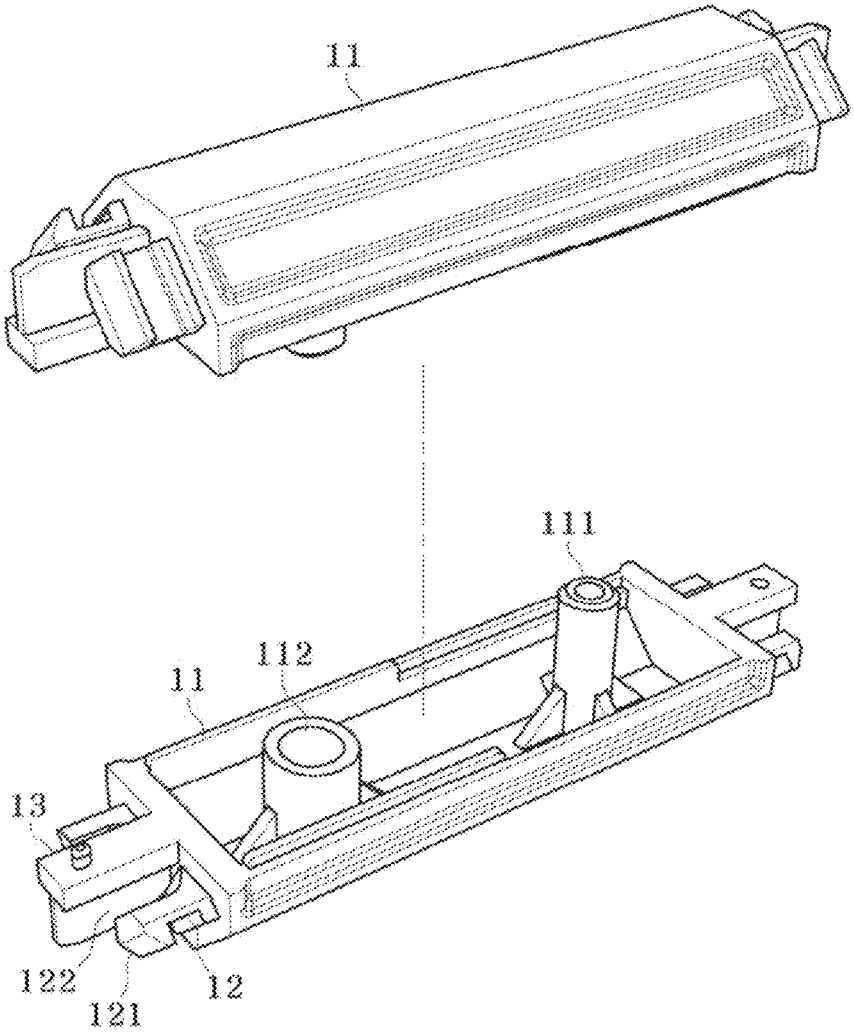
FIG. 5 is an exploded perspective view of a block body of the magnetic block toy according to the present invention.
Figure 6:
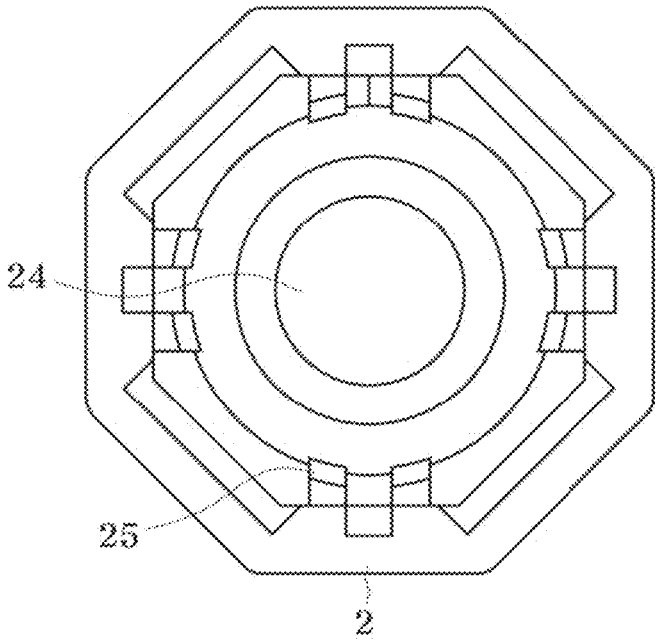
FIG. 6 is a bottom view of a cap of the magnetic block toy according to the present invention.
Figure 7A:
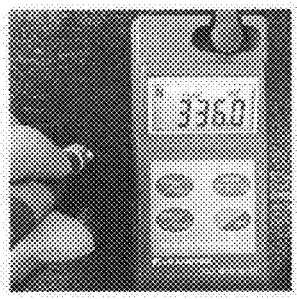
FIGS. 7A and 7B show comparative measurement results; 7B according to use of a magnet fixing board embedded in the cap of the magnetic block toy according to the present invention.
Figure 7B:
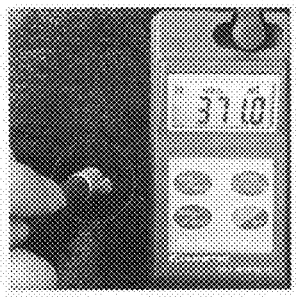
Figure 8:
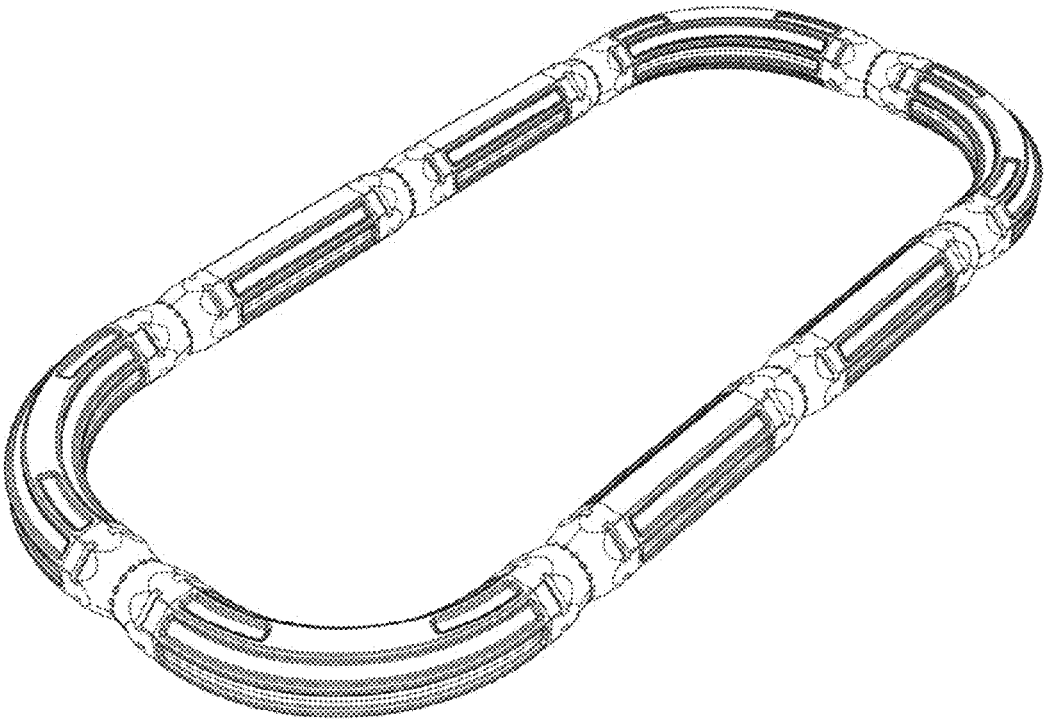
FIGS. 8 and 9 are perspective views showing used states of the magnetic block toy according to the present invention.
Figure 9:
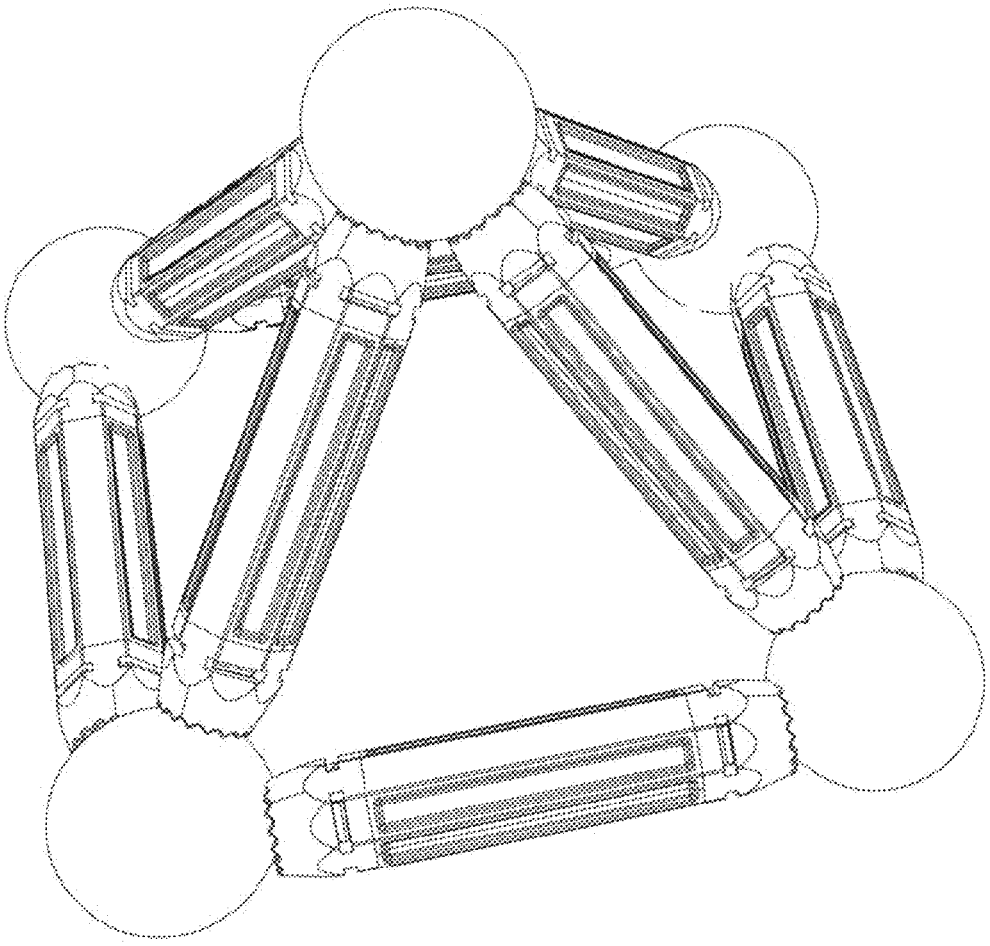

FIG. 1 is a perspective view of a magnetic block toy according to the present invention, FIG. 2 is a front view of the magnetic block toy according to the present invention, FIG. 3 is an exploded perspective view of the magnetic block toy according to the present invention, FIG. 4 is a sectional view of the magnetic block toy according to the present invention, FIG. 5 is an exploded perspective view of a block body of the magnetic block toy according to the present invention, FIG. 6 is a bottom view of a cap of the magnetic block toy according to the present invention, FIGS. 7A and 7B show comparative measurement results, wherein FIG. 7B showing a measurement according to use of a magnet fixing board embedded in the cap of the magnetic block toy according to the present invention, and FIGS. 8 and 9 are perspective views showing used states of the magnetic block toy according to the present invention.

As shown in FIGS. 1 to 6, the magnetic block toy according to the present invention includes: a block body 1 having a pair of brackets 11; caps 2 which are respectively combined to both sides of the block body 1; and a magnet 3 which is disposed inside the cap.

First, preferably, the block body 1 is formed in a bar shape and is made of a synthetic resin material.

The block body 1 is configured by a pair of brackets 11 each of which has a protrusion 111 and a groove 112 formed correspondingly to be coupled with each other. Particularly, the block body 1 may be in a straight line form or a curved line form to be assembled into various three-dimensional structures.

Moreover, preferably, the block body 1 has a round or angled cross section and is formed in various length.

Furthermore, a plurality of split support pieces 12 outwardly protrude from both sides of the block body 1, and a retaining piece 121 is formed integrally with an end portion of the support piece 12. The support pieces 12 are split in large number by a plurality of cut grooves 12, and the retaining piece 121 is formed to be inclined to the outside from an end portion of the support piece 12.

A supporter 13 protrudes from the center of both sides of the block body 1 to be coupled with the cap 2 and to support the magnet fixing board 23. It is preferable that the supporter 13 is formed in a "–" shape or a "+" shape, and a concave protrusion 25 is formed inside the cap 2 so that the supporter 13 can be forcedly fit.

That is, while the caps 2 are combined to the support piece 12 and the retaining piece 121 of the block body 1, the retaining piece 121 is caught to the retaining groove 22 of the cap 2, and at the same time, the supporter 13 is forcedly fit to the concave protrusion 25 of the cap 2 so that the cap 2 is firmly combined.

The caps 2 are respectively combined to both sides of the block body 1 and includes: a serrated coupling part 21 formed on the outer face thereof; and a retaining groove 22 formed on the outer circumferential surface so that the retaining piece 121 of the block body 1 is caught.

The coupling parts 21 are coupled with each other to interlock with each other when a plurality of magnetic block toys are combined. Especially, when the magnetic block toys are combined, a distance between the magnets gets shorter and a combining force between the magnetic block toys is increased by the coupling parts 21. Moreover, when the magnetic block toys are combined by the magnetic force of the magnets 3, the coupling parts 21 which interlock with each other can restrain a relative rotation of the magnetic block toys.

Therefore, as described above, the blocks are firmly bonded through the serrated coupling parts 21 formed on the caps 2 so that assembled structures can stand for a long time without being easily destroyed.

The cap 2 includes: a magnet fixing board 23 which is disposed inside the cap 2 and is made of a metallic material to fix the magnet 3; and a magnet exposing hole formed at the center of the cap 2 to partially expose the magnet 3 when the caps are coupled with each other.

The magnet fixing board 23 is arranged at the rear of the magnet 3 which is disposed inside the cap 2 to generate a magnetic force and serves to fix the magnet 3 and to add the bonding force by the magnet 3. As shown in FIG. 7B, the case that the magnet fixing board (for instance, a blackboard) is used is higher in the magnetic force by the magnet than the case that the magnet fixing board 23 is not used as shown in FIG. 7A. Accordingly, when the magnet fixing board 23 is used, the bonding force between the magnets is more powerful.

In the meantime, the magnetic block toy according to the present invention can show various colors suitable for children's tastes because the block bodies 1 and the caps 2 have various colors, thereby arousing children's interest and enhancing an aesthetic sense.

As shown in FIGS. 8 and 9, the magnetic block toy according to the present invention can make three-dimensional structures through combination of straight lines and curves lines because the magnetic block toy is configured of straight lines and curved lines. Besides the above, the magnetic block toy according to the present invention can be combined with spherical structures and can be assembled into three-dimensional structures of various forms.

While the present invention has been particularly shown and described with reference to exemplary embodiments thereof, it will be understood by those of ordinary skill in the art that various changes and modifications may be made therein without departing from the technical scope of the present invention. It will be also understood by those of ordinary skill in the art that the scope of the present invention must be interpreted by the claims of the present invention including lots of changes and modifications.

EXPLANATION OF ESSENTIAL REFERENCE NUMERALS IN DRAWINGS

1: block body
11: bracket
111: protrusion, 112: groove
12: support piece
121: retaining piece, 122: cut groove
13: supporter
2: cap
21: coupling part
22: retaining groove
23: magnet fixing board
24: magnet exposing hole
25: concave protrusion
3: magnet

The invention claimed is:

1. A magnetic block toy comprising:

a block body having a pair of brackets each of which has a protrusion and a groove formed on the inner face to correspond to each other and are coupled with each other;

caps which are respectively combined to both sides of the block body and each of which has a serrated coupling part formed on the outer surface; and a magnet which is disposed inside the cap to generate a magnetic force, wherein a plurality of split support pieces outwardly protrude from both sides of the block body, a retaining piece is formed integrally with an end portion of the support piece, and a retaining groove is formed on the outer circumferential surface of the cap so that the retaining piece is caught to the retaining groove.

2. The magnetic block toy according to claim 1, wherein the block body is formed in one selected from a straight line form and a curved line form.

3. The magnetic block toy according to claim 1, wherein a magnet exposing hole is formed at the center of the cap to partially expose the magnet to the outside when the caps are coupled with each other.

4. A magnetic block toy comprising:

a block body having a pair of brackets each of which has a protrusion and a groove formed on the inner face to correspond to each other and are coupled with each other;

caps which are respectively combined to both sides of the block body and each of which has a serrated coupling part formed on the outer surface; and a magnet which is disposed inside the cap to generate a magnetic force, wherein a magnet fixing board for fixing the magnet is disposed inside the cap, and supporters protrude from the center of both sides of the block body to be coupled with the caps and support the magnet fixing board.

5. The magnetic block toy according to claim 4, wherein the block body is formed in one selected from a straight line form and a curved line form.

6. The magnetic block toy according to claim 4, wherein a magnet exposing hole is formed at the center of the cap to partially expose the magnet to the outside when the caps are coupled with each other.

* * * * *